US007252573B2

(12) United States Patent
Mann

(10) Patent No.: US 7,252,573 B2
(45) Date of Patent: Aug. 7, 2007

(54) BRASSIERE FRAME

(76) Inventor: Michele Mann, 8157 McCauly Ct., Cincinnati, OH (US) 45241

( * ) Notice: Subject to any disclaimer, the term of this patent is extended or adjusted under 35 U.S.C. 154(b) by 0 days.

(21) Appl. No.: 11/272,930

(22) Filed: Nov. 14, 2005

(65) Prior Publication Data

US 2007/0123144 A1 May 31, 2007

(51) Int. Cl.
*A41C 3/10* (2006.01)
*A41H 5/00* (2006.01)
*A41C 3/00* (2006.01)

(52) U.S. Cl. ..... 450/1; 450/39; 223/84; 223/66; 223/69

(58) Field of Classification Search ..... 450/1, 450/39, 40, 41–45; 223/84, 85, 52, 57, 66, 223/69; 68/235, 213, 212; 8/150
See application file for complete search history.

(56) References Cited

U.S. PATENT DOCUMENTS

| | | | | | |
|---|---|---|---|---|---|
| 2,089,266 | A | * | 8/1937 | Kalvin | 211/85.3 |
| 2,490,508 | A | | 12/1949 | Delgatlo | 223/23 |
| 2,676,735 | A | * | 4/1954 | Hellman | 223/66 |
| 2,676,736 | A | | 4/1954 | Hellman | 223/66 |
| 2,730,275 | A | * | 1/1956 | Flores | 223/66 |
| 2,755,004 | A | * | 7/1956 | Schumacher | 223/66 |
| 2,756,911 | A | | 7/1956 | Kantor et al. | 223/68 |
| 2,815,157 | A | | 12/1957 | Badgley | 223/66 |
| 2,951,621 | A | * | 9/1960 | Cheney | 223/66 |
| 3,085,723 | A | * | 4/1963 | Vanderburg | 223/66 |
| 3,176,686 | A | * | 4/1965 | Barnes | 128/846 |
| 3,346,149 | A | | 10/1967 | Tiss | 223/66 |
| 3,837,476 | A | | 9/1974 | Schwartz | 206/45.34 |
| 4,717,353 | A | * | 1/1988 | Block | 439/310 |
| 5,172,837 | A | | 12/1992 | Finney, Jr. et al. | 223/23 |
| 5,556,013 | A | | 9/1996 | Mayer | 223/84 |
| 5,829,083 | A | * | 11/1998 | Sutton | 8/150 |
| 5,971,236 | A | * | 10/1999 | DesForges et al. | 223/84 |
| 6,234,368 | B1 | * | 5/2001 | DesForges et al. | 223/84 |
| 6,471,102 | B2 | | 10/2002 | Hancock | 223/84 |
| 6,742,683 | B1 | * | 6/2004 | Phan | 223/84 |
| 6,761,291 | B2 | | 7/2004 | Moskovitz et al. | 223/84 |
| 2005/0020182 | A1 | | 1/2005 | Moskovitz et al. | |

* cited by examiner

*Primary Examiner*—Gloria M. Hale
(74) *Attorney, Agent, or Firm*—Wood, Herron & Evans LLP

(57) ABSTRACT

A frame for maintaining the shape of a brassiere during drying and storage includes one or more hemispherically-shaped shells having a plurality of apertures formed therethrough. The shells may be formed from a first polymeric material and may further include a second polymeric material disposed on an outer surface thereof, to frictionally retain a cup of the brassiere. In one embodiment, first and second shells are joined by an interconnection extending therebetween. The interconnection may maintain the shells in a tandem arrangement, or may permit the shells to be positioned such that their respective peripheral edges confront one another.

20 Claims, 16 Drawing Sheets

BRASSIERE FRAME

FIELD OF THE INVENTION

The present invention relates generally to devices for protecting garments, and more particularly to a frame for supporting and protecting a brassiere during drying, storage, and travel.

BACKGROUND OF THE INVENTION

Brassieres are common articles of clothing for women and generally comprise two cups, two shoulder straps, two back straps, and a latching mechanism provided either on the back straps or on the front of the brassiere, between the cups at the intercup bridge. Over the years, the construction of brassieres has developed to conform to fashion and to provide functional benefits to wearers. In particular, the cups of brassieres may be constructed with padding or may be shaped to conform to the contours of the body, thereby providing comfort, support, and/or a pleasing appearance. One known brassiere construction, commonly referred to as a T-shirt brassiere, utilizes a foam lining to provide support and shaping of the bust while also ensuring a smooth appearance of garments worn over the brassiere.

Due to their delicate material and construction, brassieres require special attention and care during cleaning, to ensure that the shape of the cups is not distorted and to prevent the formation of creases or indentations in the cup material. In particular, special attention and care must be exercised during the washing and drying of brassieres to ensure that the cups retain their desired shape during drying. When storing or transporting brassieres, such as during travel, it is important to ensure that the material is not damaged and that the cups are not crushed or otherwise distorted. These concerns are even more acute with respect to T-shirt brassieres.

Devices such as those described in U.S. Pat. No. 6,761,291 to Moskovitz et al. and U.S. Pat. No. 6,742,683 to Phan have been previously proposed for washing and storing brassieres. Such devices are often bulky, inconvenient for travel, and utilize excessive space in drawers or lingerie chests. These previous devices also do not adequately facilitate efficient drying of brassieres after laundering while preventing the formation of undesirable indentations or creases in foam or other delicate material used in brassieres. A need therefore exists for a device which can protect brassieres during drying, storage and transportation and which overcomes drawbacks of the prior art, such as those described above.

SUMMARY OF THE INVENTION

The present invention meets this need via a frame for protecting and maintaining the shape of brassieres during drying, storage, and/or travel. In one aspect of the invention, the frame comprises one or more hemispherically-shaped shells formed from a first polymeric material that is sufficient to provide a rigid support for the brassiere. The shape of the shell corresponds to the shape of the bust and prevents the brassiere cups from becoming distorted or otherwise misshapen while placed over the shell. A plurality of apertures formed through the shell permits air to circulate through the material of the cups to thereby facilitate efficient drying of the brassiere after laundering.

In another aspect of the invention, a second polymeric material may be applied on the shell to frictionally retain the cup of a brassiere thereon. The second polymeric material may be disposed on selected portions of the outer surface of the shell, or the second polymeric material may completely cover the outer surface of the shell. The second polymeric material may also be provided on the interior of the shell, opposite the outer surface, or the shell may be completely encapsulated in the second polymeric material. The second polymeric material is selected to have a durometer that is less than the durometer of the first polymeric material used to form the shell, to thereby improve the frictional holding capability of the second polymeric material.

In another aspect of the invention, the frame further includes one or more clasps that are positioned to receive a strap or an edge of a cup, so that the brassiere may be secured to the shell. In one embodiment, the frame has a first clasp positioned to receive a strap of the brassiere, and a second clasp positioned to receive a bridge that extends between the cups of the brassiere, to thereby secure the brassiere to the frame.

In yet another aspect of the invention, the frame comprises first and second shells, as described above. The shells may be coupled together by a connecting member extending therebetween. The connecting member may be configured to maintain the shells in a tandem arrangement, or it may be configured to permit positioning the shells such that their respective peripheral edges are placed in a confronting arrangement that is convenient for storage or travel.

In another aspect of the invention, the frame includes at least one hemispherical-shaped shell, a plurality of apertures formed through the shell to facilitate drying a brassiere secured thereon, and at least one clasp disposed on an outer peripheral edge of the shell to resiliently engage a strap of the brassiere. The frame may further include at least one second clasp operatively positioned relative to the first clasp to receive a bridge of the brassiere when a strap of the brassiere is received through the first clasp.

In yet another aspect of the invention, a method of maintaining the shape of a brassiere includes placing a frame as described above within at least one cup of a brassiere and frictionally engaging the cup of the brassiere to secure the brassiere to the frame. The method may further include inserting a strap of the brassiere through a first clasp, inserting a bridge of the brassiere through a second clasp, and folding first and second shells about a hinged coupling.

The features and objectives of the present invention will become more readily apparent from the following Detailed Description taken in conjunction with the accompanying drawings.

BRIEF DESCRIPTION OF THE DRAWINGS

The accompanying drawings, which are incorporated in and constitute a part of this specification, illustrate embodiments of the invention and, together with a general description of the invention given above, and the detailed description given below, serve to explain the invention.

DETAILED DESCRIPTION

Figure 1:
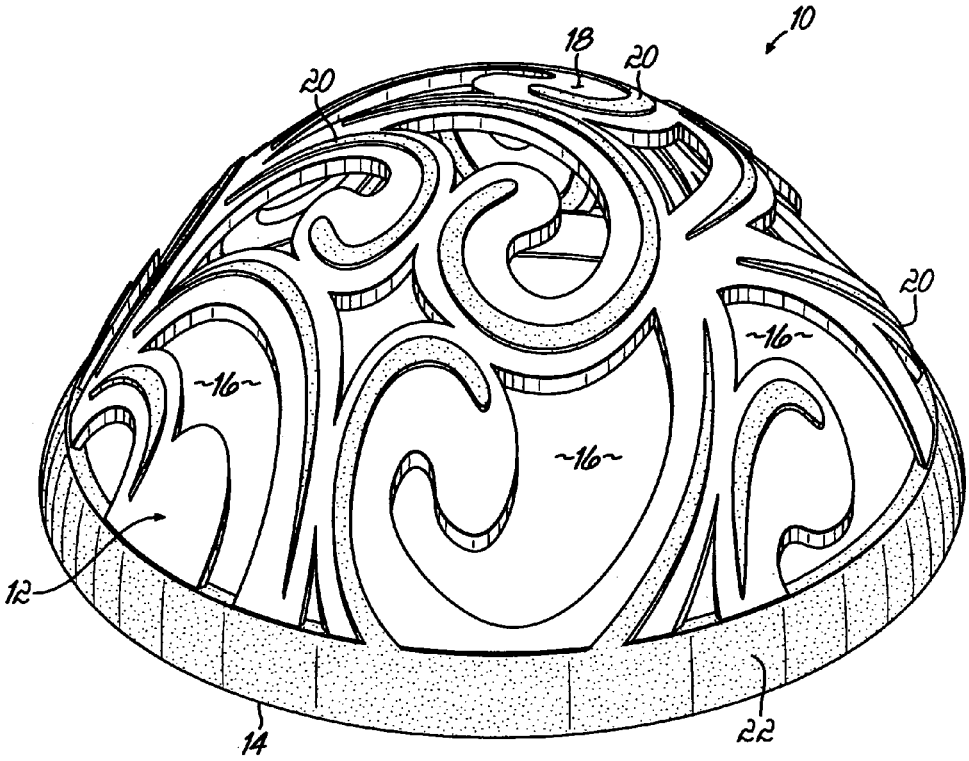
FIG. 1 is a perspective view of a first exemplary frame for supporting a brassiere in accordance with the present invention.
Figure 2:
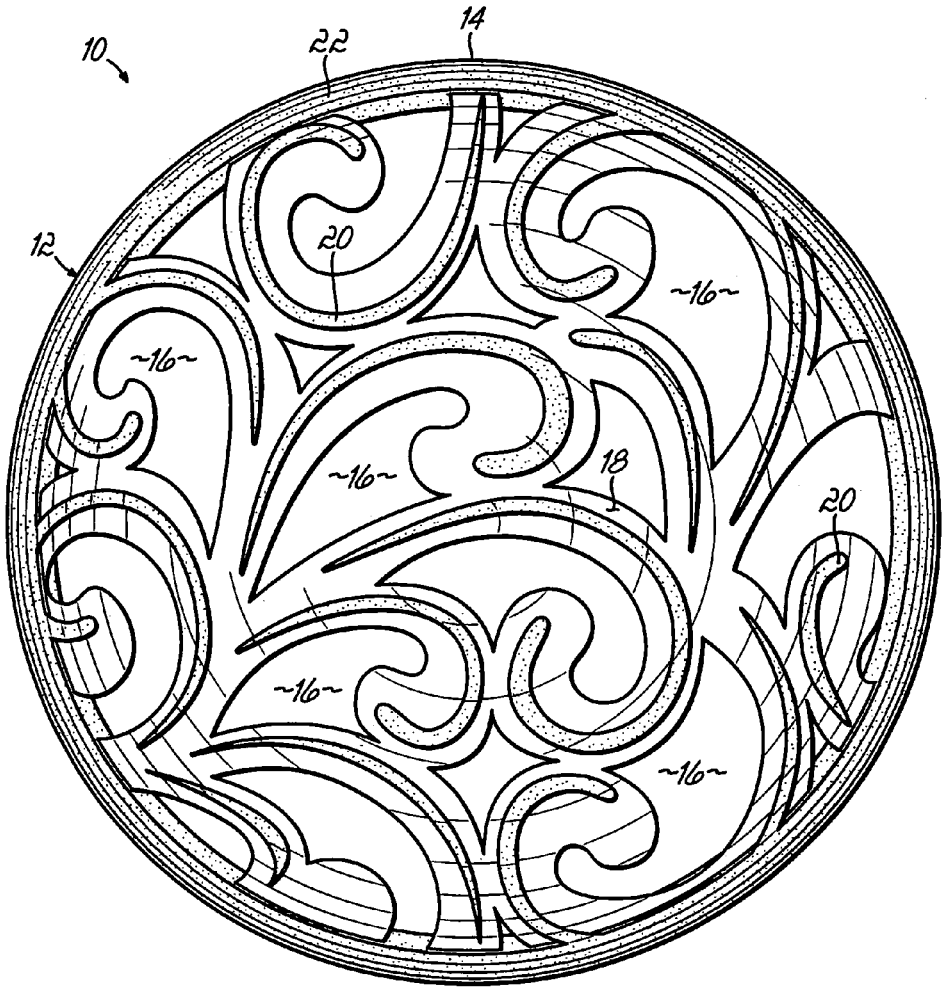
FIG. 2 is a top plan view of the frame of FIG. 1.
Figure 3:
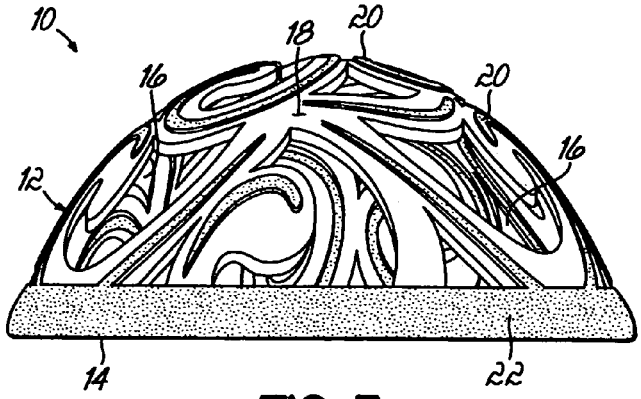
FIG. 3 is a right-side elevation view of the frame of FIG. 1.
Figure 4:
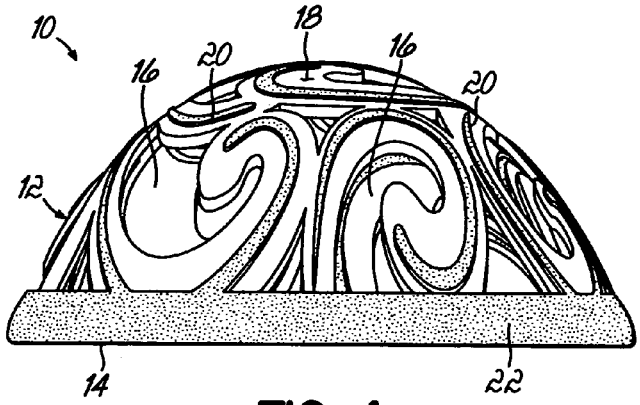
FIG. 4 is a rear-side elevation view of the frame of FIG. 1.
Figure 5:
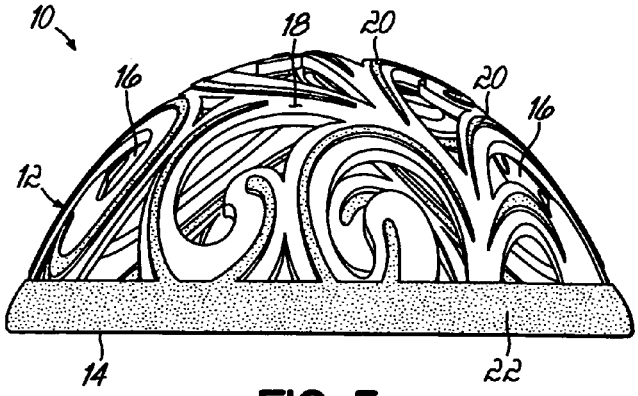
FIG. 5 is a left-side elevation view of the frame of FIG. 1.
Figure 6:
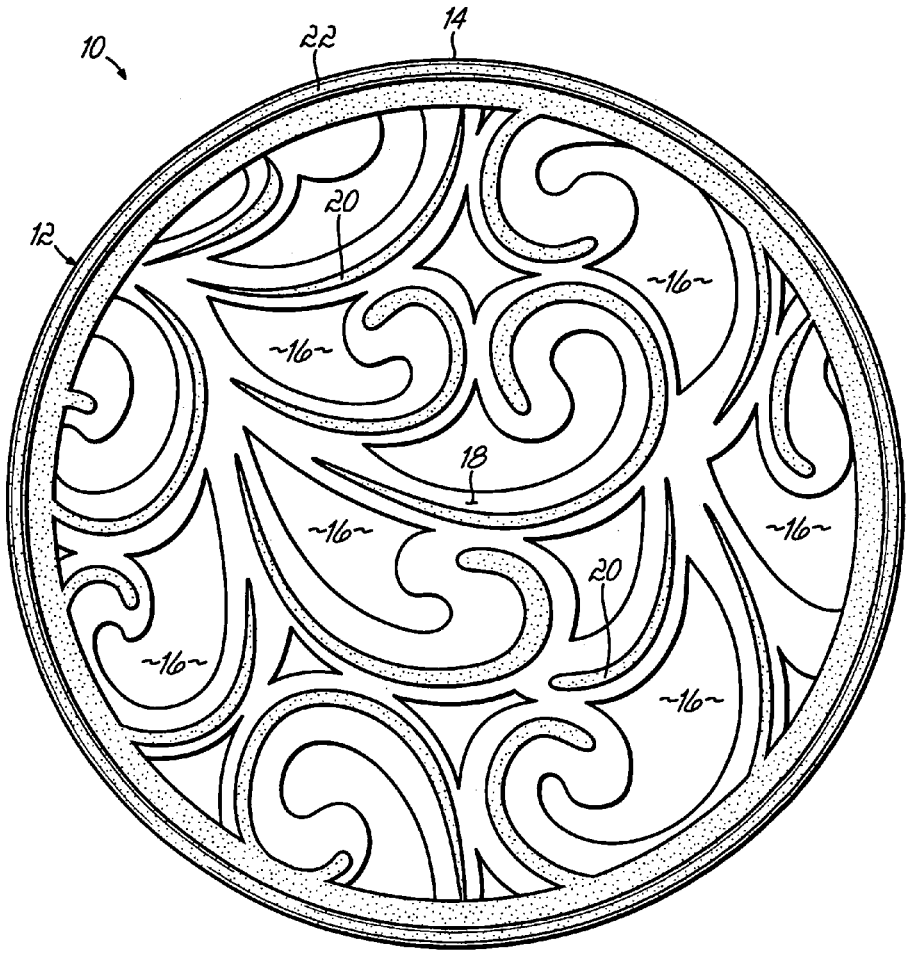
FIG. 6 is a bottom plan view of the frame of FIG. 1.

FIGS. 1–6 depict a first exemplary embodiment of a frame 10 for supporting a brassiere in accordance with the principles of the present invention. The frame includes a hemispherically-shaped shell 12. The shell 12 may be molded from a first polymeric material to provide a rigid structure which can support the cup of a brassiere thereon. In one embodiment, the durometer of the first polymeric material is in the range of approximately 70 to 90 Shore A, or as much as approximately 45 to 95 Shore D. The generally hemispherical shape of the shell 12 is configured to correspond to the contour of the bust, and the shell 12 may be provided in various sizes corresponding to brassiere cup sizes. In the embodiment shown in FIGS. 1–6, the entire outer peripheral edge 14 of the shell lies in a common plane, such that the entire peripheral edge 14 will be supported when the shell 12 is placed on a flat surface. Alternatively, the outer peripheral edge 14 may be contoured, or formed in an undulating arrangement, as will be discussed below.

A plurality of apertures 16 are formed through the shell 12 at selected locations on the outer surface 18. The apertures 16 allow air to flow therethrough, to facilitate the drying of brassiere cups which may be placed over the frame 10 after laundering. Moreover, the apertures 16 reduce the overall weight of the frame 10 so that the frame 10 is lightweight and easily transported. The apertures 16 may be provided in patterned shapes to create an aesthetically pleasing appearance of the frame 10, as shown in FIGS. 1–6. Alternatively, the apertures 16 may simply comprise holes formed through the shell 12 in a random or patterned arrangement.

Figure 7:
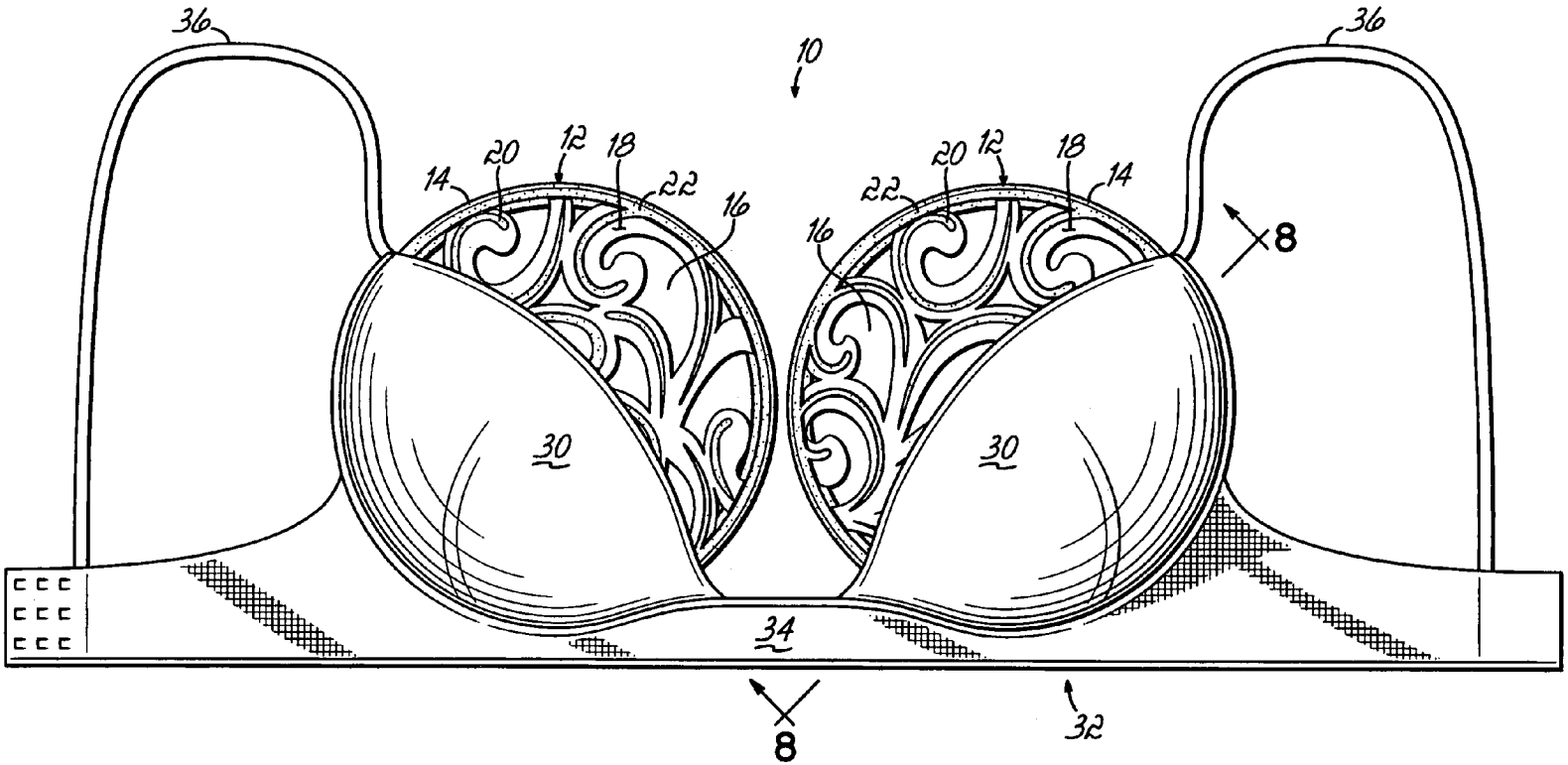
FIG. 7 is a top plan view depicting the frame of FIG. 1 with a brassiere.
Figure 8:
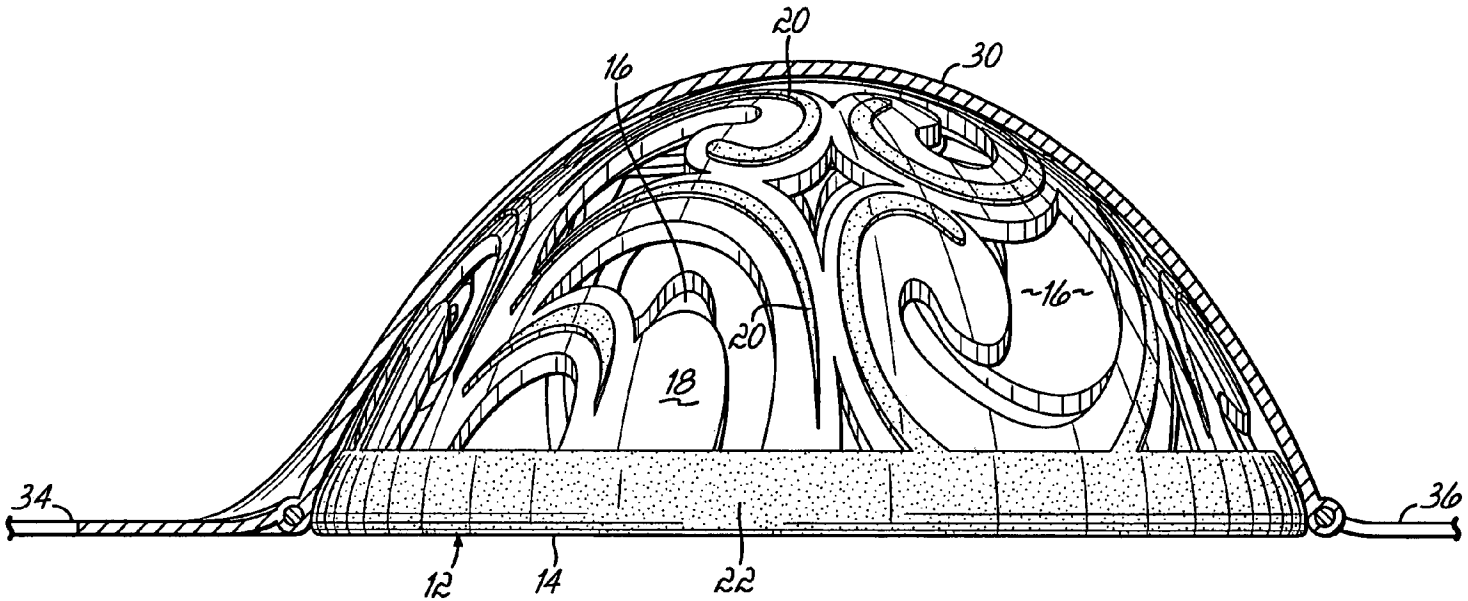
FIG. 8 is a cross-sectional view of the frame and brassiere of FIG. 7, taken along line 8—8 and depicting a front-side elevation view of the frame of FIG. 1.
Figure 9:
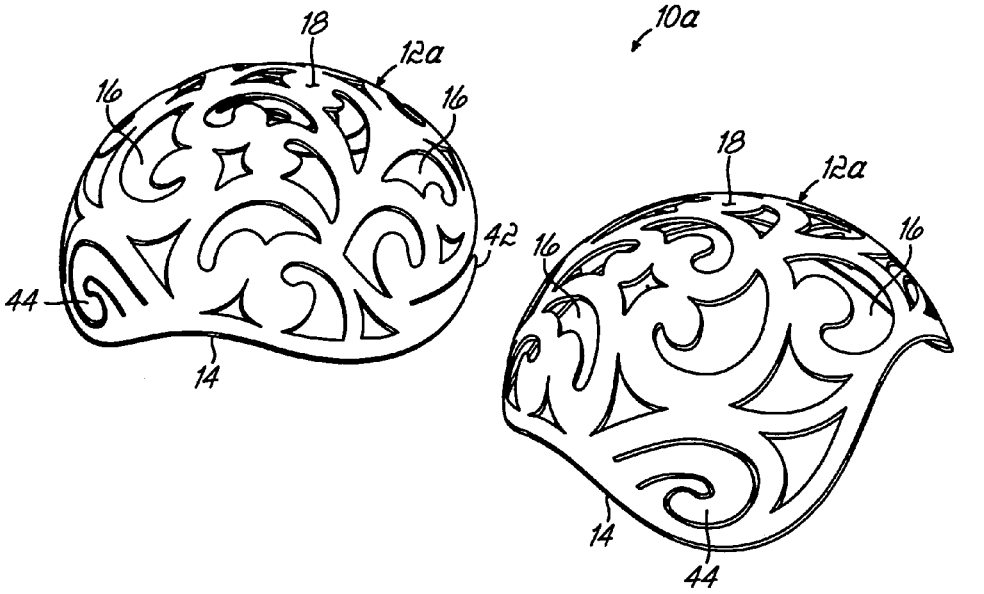
FIG. 9 is a perspective view of a second exemplary frame, in accordance with the present invention, comprising first and second shells.
Figure 10:
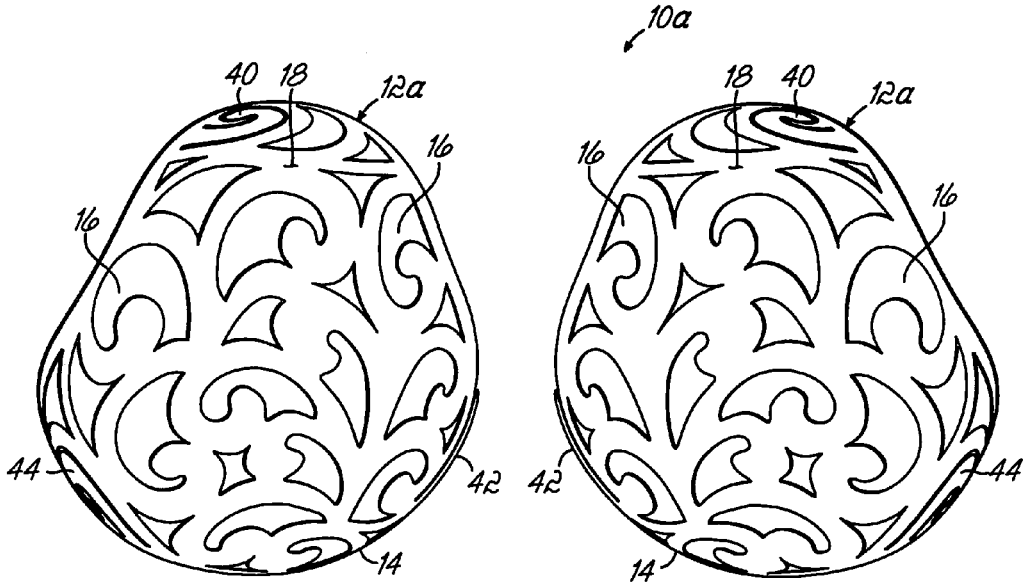
FIG. 10 is a top plan view of the frame of FIG. 9.
Figure 11:
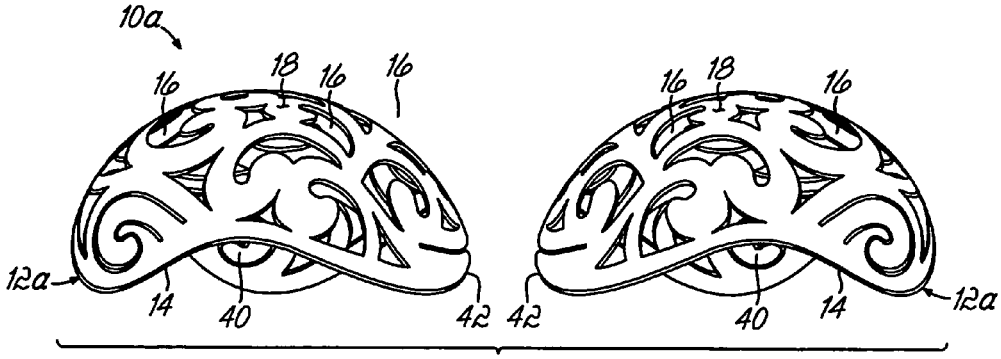
FIG. 11 is a front-side elevation view of the frame of FIG. 9.
Figure 12:
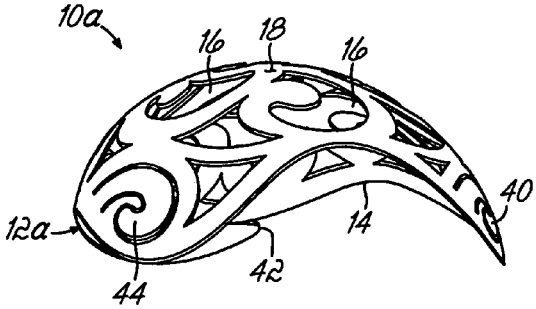
FIG. 12 is a right-side elevation of the right shell of the frame of FIG. 9.
Figure 13:
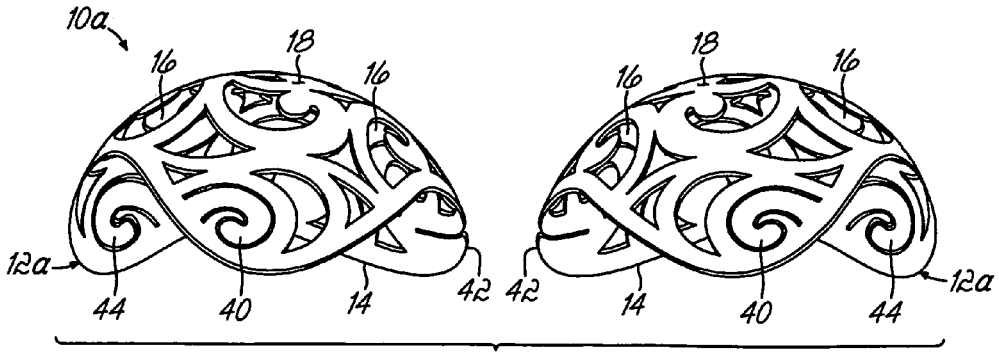
FIG. 13 is a rear-side elevation view of the frame of FIG. 9.
Figure 14:
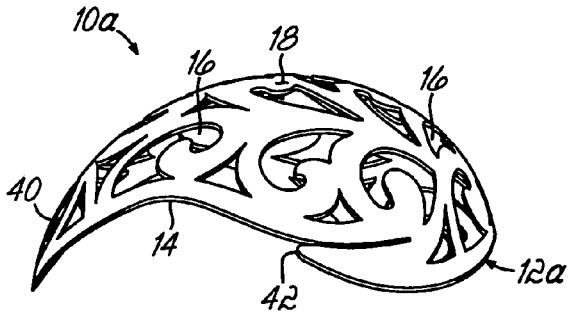
FIG. 14 is a left-side elevation view of the right shell of the frame of FIG. 9.
Figure 15:
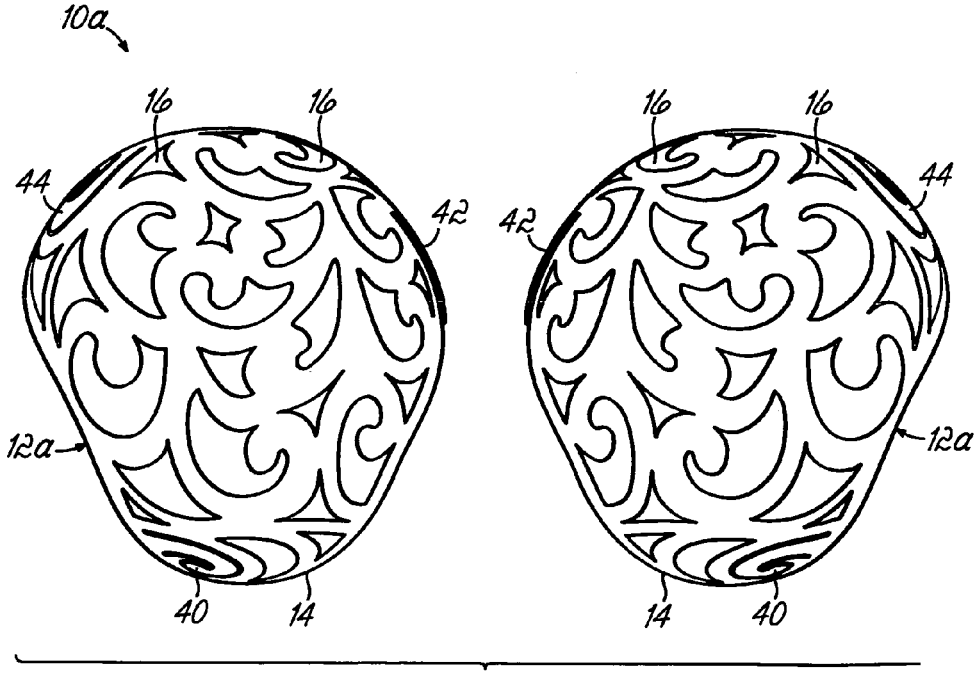
FIG. 15 is a bottom plan view of the frame of FIG. 9.

As depicted in FIGS. 1–6, a second polymeric material 20 is located on at least selected portions the outer surface 18 of the shell 12. The second material 20 may also be located on selected portions of the interior of the shell, opposite outer surface 18. In FIGS. 1–6, the second polymeric material 20 is arranged on the outer surface 18 in a pattern corresponding to the pattern of the apertures 16 formed through the shell 12, and a continuous ring 22 of the second polymeric material 20 encircles the peripheral edge 14 of the shell 12. Those skilled in the art will recognize that the second polymeric material 20 may be located on the outer surface 18 of the shell 12 in a number of different arrangements or patterns, or may even cover the entire outer surface 18 of the shell 12. Alternatively, the second polymeric material may completely encapsulate shell 12. The second material 20 is formed from a durometer which is lower than the durometer of the first polymeric material used to form the shell 12. The softer durometer of the second polymeric material 20 enables the frame 10 to frictionally engage the inner surfaces of a brassiere cup 30 when it is inserted into the cup 30, so that the brassiere cup 30 will be secured to the frame 10, as depicted in FIGS. 7 and 8. As the material of the brassiere cup 30 is stretched over the shell 12, as best depicted in FIG. 8, the softer durometer of the second polymeric material 20 helps to frictionally engage and retain the cup 30 on the frame 10.

In FIG. 7, the frame 10 includes first and second hemispherically-shaped shells 12. The first and second shells 12 may be inserted within the cups 30 of a brassiere 32, as shown in FIG. 7, and the first and second shells 12 may be placed on a flat surface with the entire outer peripheral edges 14 engaging the flat surface so that the brassiere 32 is supported by the frame 10 as shown. In this arrangement, the shells 12 help to maintain the desired shape of the cups 30, for example, during drying of the brassiere 32 after laundering, or during storage, such as in a dresser drawer. Alternatively, the first and second shells 12 may be positioned such that the corresponding peripheral edges 14 are arranged in a substantially confronting arrangement, by folding the brassiere cups 30 and shells 12 about the intercup bridge 34, for convenient storage of the brassiere in a dresser drawer or for stowing in a suitcase during travel.

FIGS. 9–16 depict a second exemplary embodiment of a frame 10*a* for supporting a brassiere 32 in accordance with the principles of the present invention. In the embodiment shown, the frame 10*a* includes first and second generally hemispherically-shaped shells 12*a*, which may be formed from a first polymeric material as described above, but without a second polymeric material disposed on the outer surface 18 thereof. Alternatively, a second polymeric material may be provided on selected areas of the outer surfaces 18, or the entire outer surfaces of the shells 12*a* may be covered with the second polymeric material. The second polymeric material may also be provided on selected portions of the shell interior, opposite outer surface 18, or may completely encapsulate the shell 12*a*, as described above.

While the frame 10 depicted in FIGS. 1–8 includes one or more shells 12 having a generally spherical construction, the shells 12*a* of FIGS. 9–16 are even further contoured to correspond to the shape of the bust. As a result of this further contouring, the frame 10*a* includes left and right-side shells 12*a* which are substantially mirror images of one another. These shells 12*a* are similar in construction to those described above with respect to FIGS. 1–8 and like features have been similarly numbered.

Figure 16:
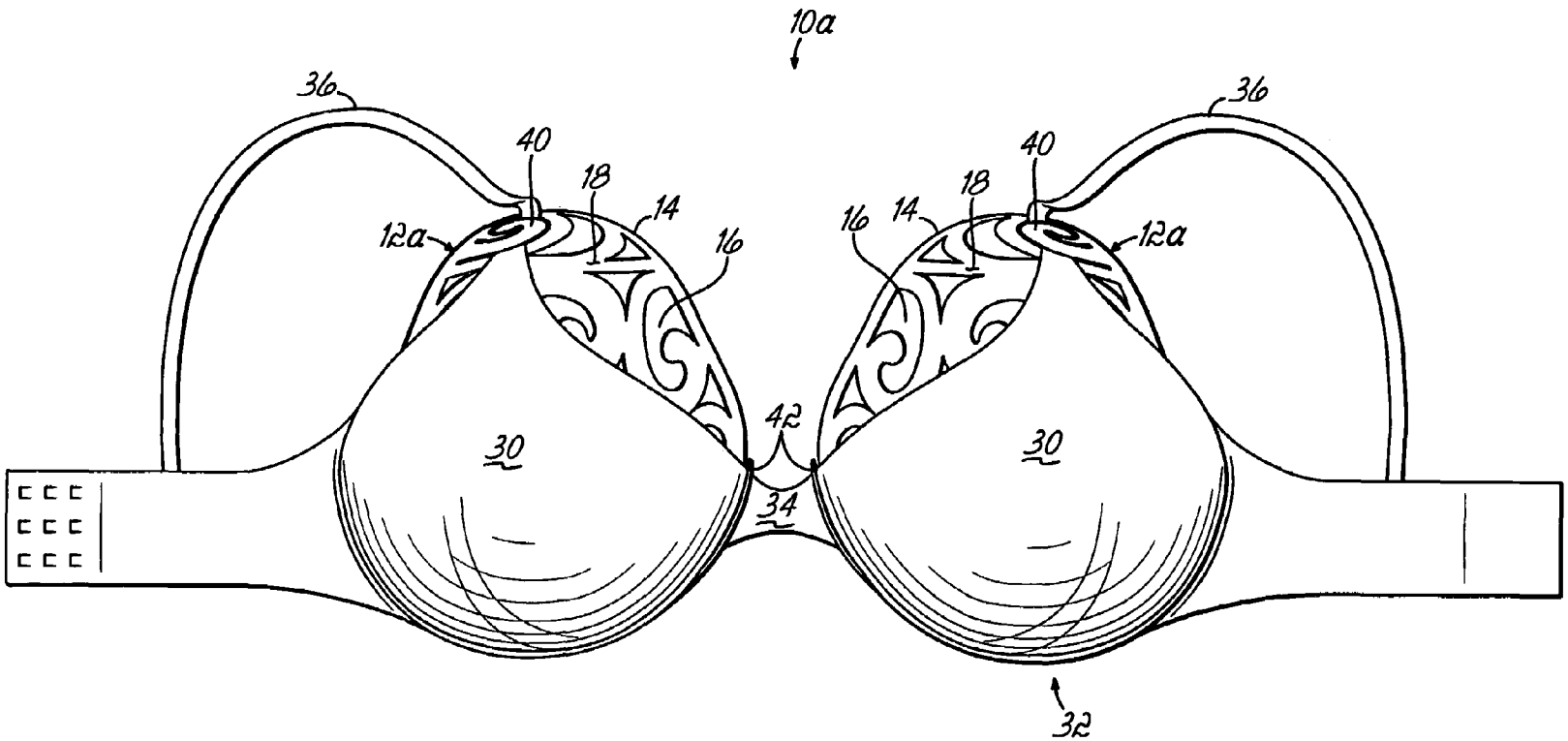
FIG. 16 is a top plan view of the frame of FIG. 9 with a brassiere.
Figure 17:
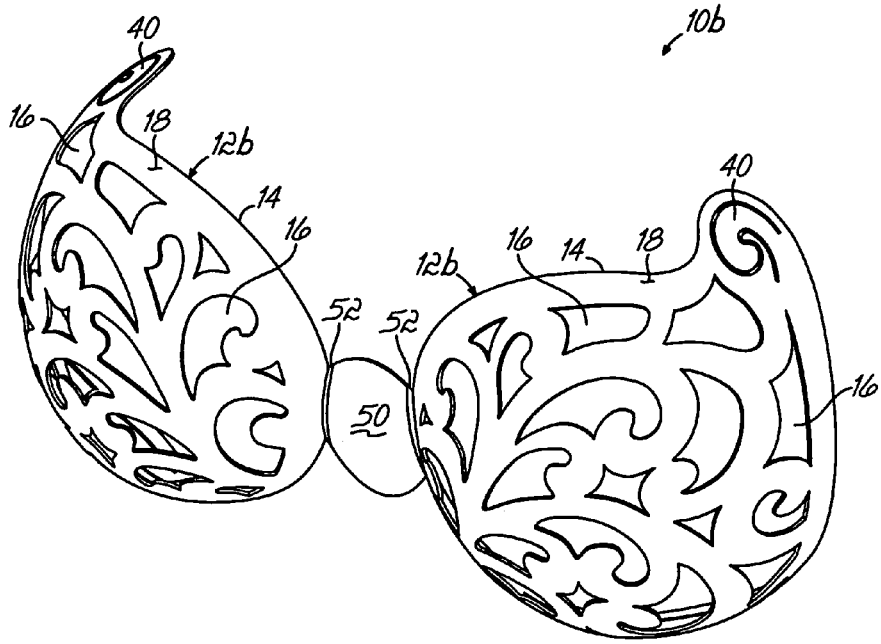
FIG. 17 is a perspective view of a third exemplary frame in accordance with the present invention.
Figure 18:
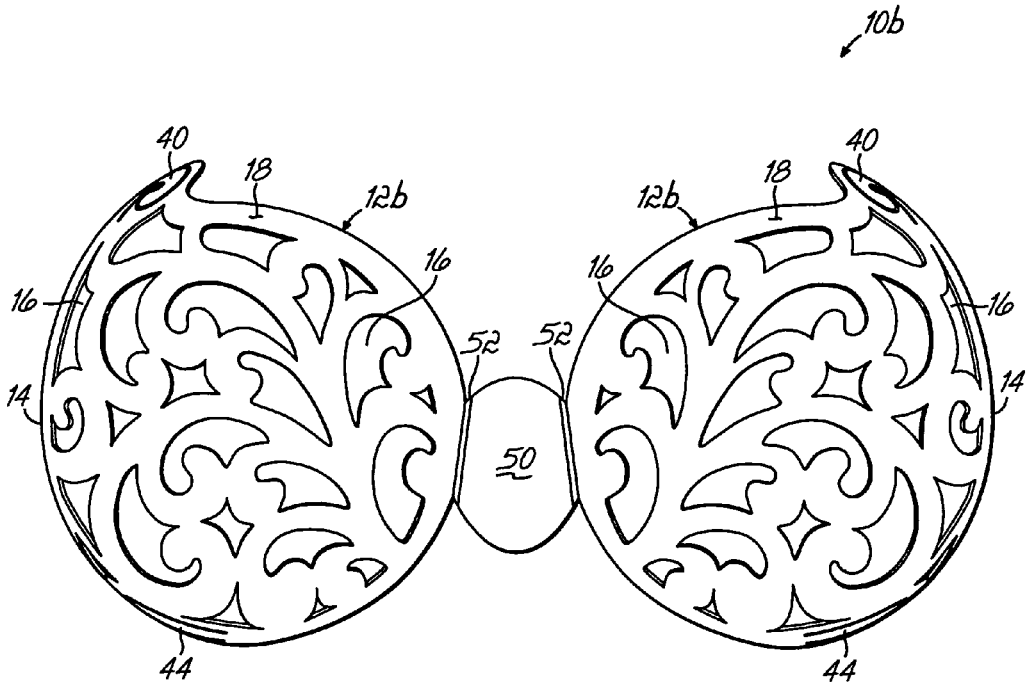
FIG. 18 is a top plan view of the frame of FIG. 17.
Figure 19:
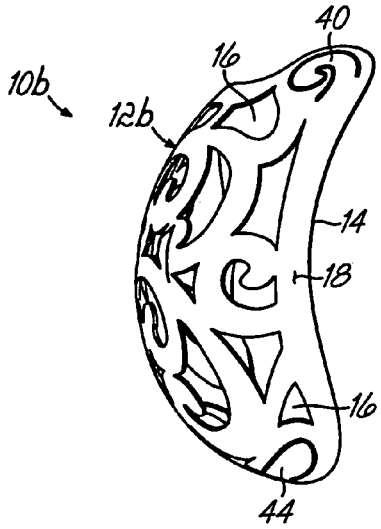
FIG. 19 is a right-side elevation view of the frame of FIG. 17.
Figure 20:
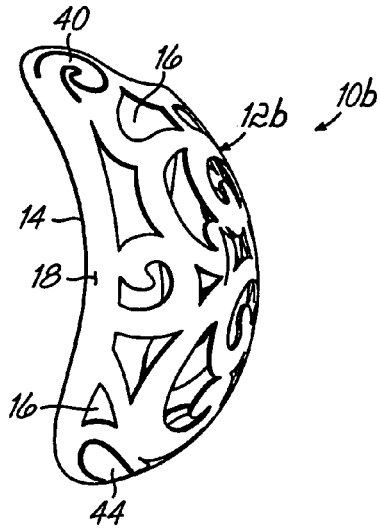
FIG. 20 is a left-side elevation view of the frame of FIG. 17.
Figure 21:
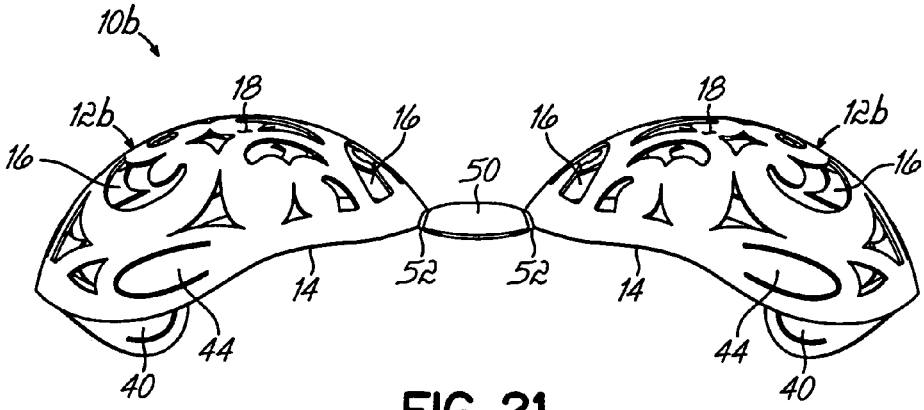
FIG. 21 is a front-side elevation view of the frame of FIG. 17.
Figure 22:
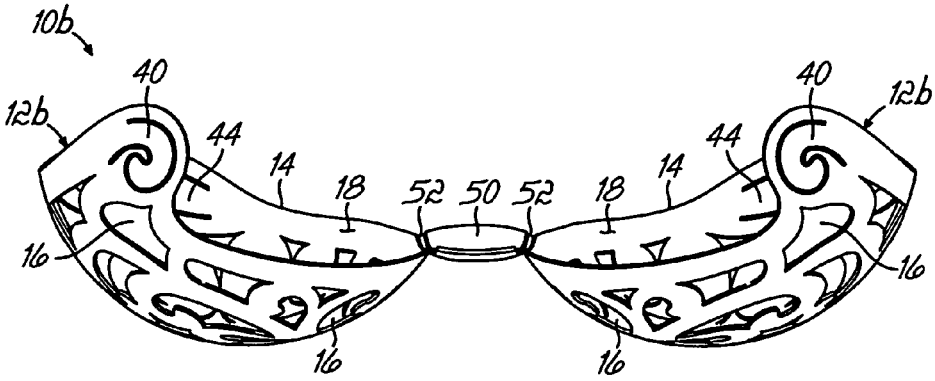
FIG. 22 is a rear-side elevation view of the frame of FIG. 17.
Figure 23:
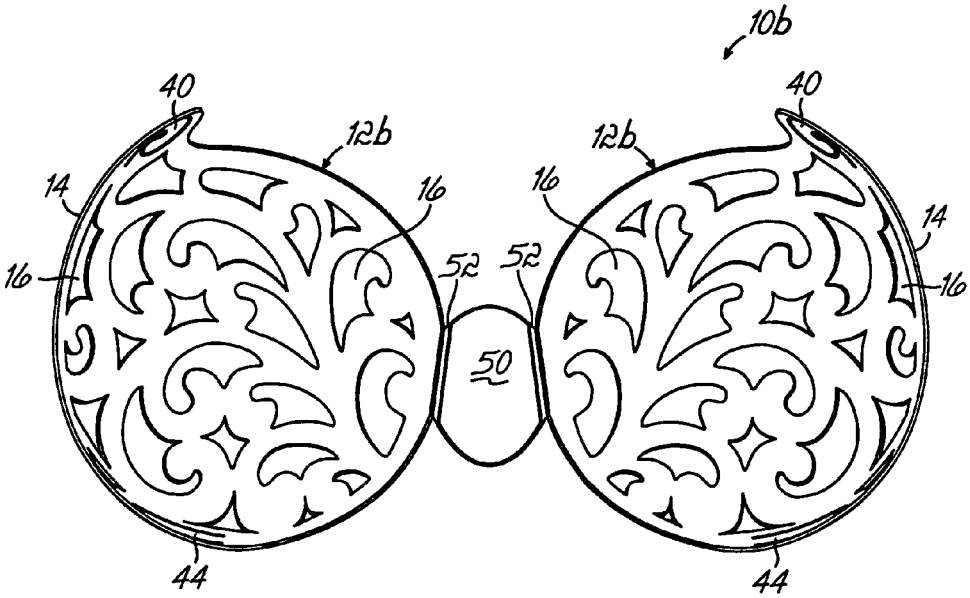
FIG. 23 is a bottom plan view of the frame of FIG. 17.
Figure 24:
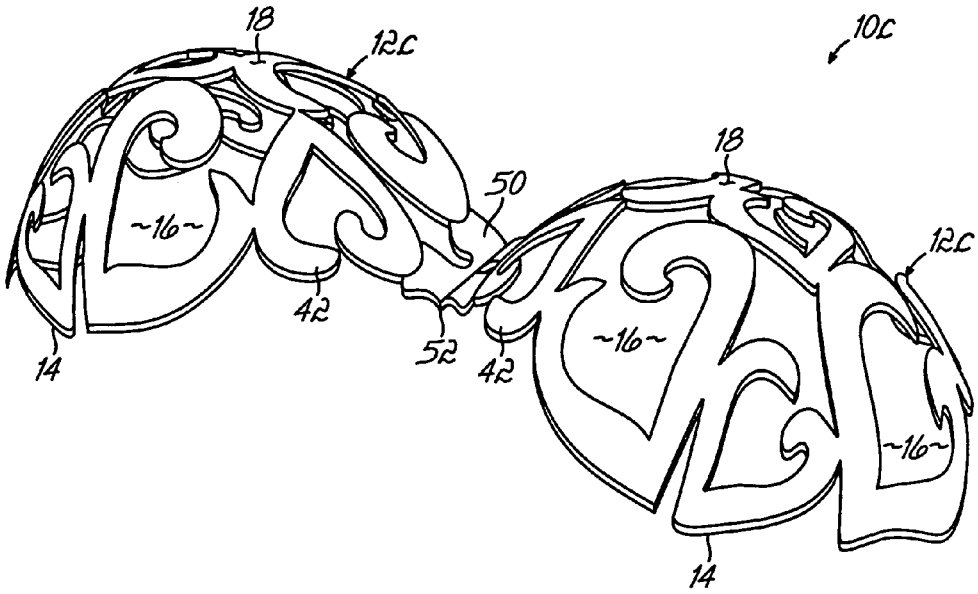
FIG. 24 is a perspective view of a fourth exemplary frame in accordance with the present invention.
Figure 25:
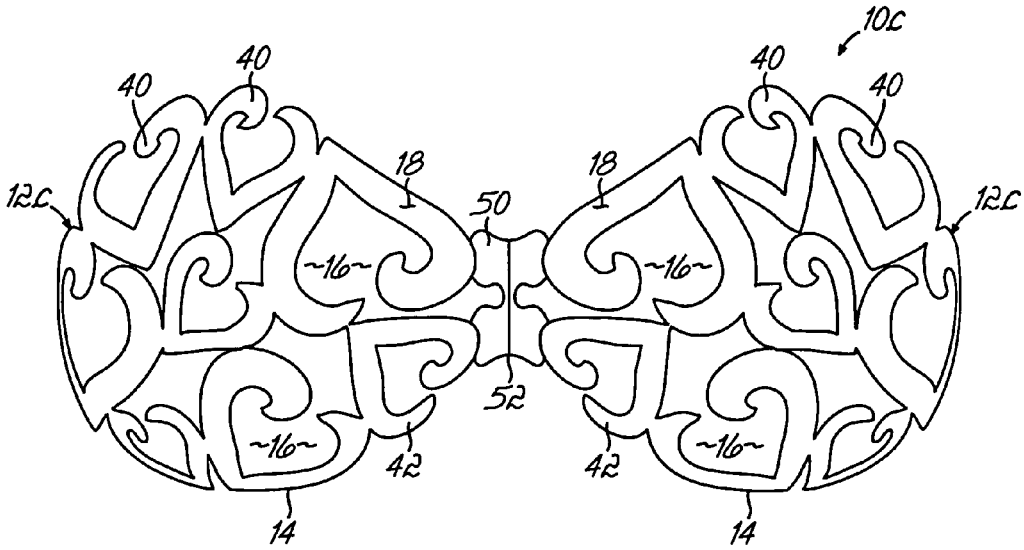
FIG. 25 is a top plan view of the frame of FIG. 4.
Figure 26:
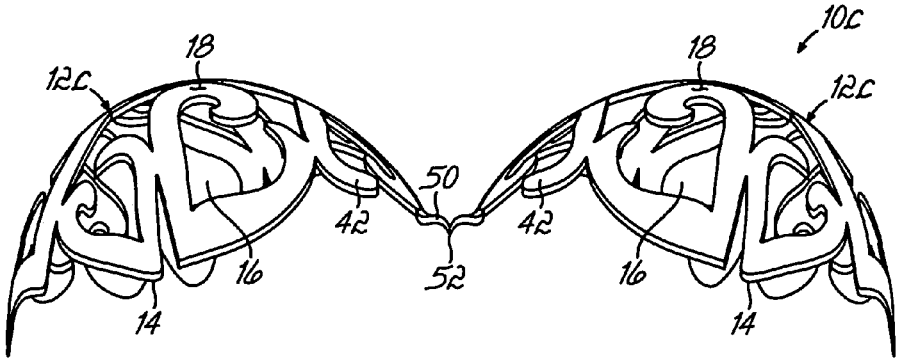
FIG. 26 is a front-side elevation view of the frame of FIG. 24.

The left and right-side shells 12*a* further include first clasps 40 disposed near the respective outer peripheral edges 14 of the shells 12*a* for receiving the shoulder straps 36 or an edge of a cup 30 of a brassiere 32 to facilitate securing the brassiere 32 to the shell 12*a*, as best depicted in FIG. 16. As shown therein, the left and right-side shells 12*a* are inserted into the respective cups 30 of the brassiere 32 as described above, and the shoulder straps 36 may be pulled through the respective first clasps 40 to stretch and secure the cups 30 to the respective shells 12*a*. In this arrangement, the shells 12*a* may be used to retain the shape of the cups 30 during drying, storage, or transportation of a brassiere 32 secured thereto.

The left and right-side shells 12*a* of the frame 10*a* may be placed directly on a flat surface such that the outer peripheral edges 14 of the shells 12*a* contact the surface and the shells 12*a* support the cups 30 of the brassiere 32 in a tandem arrangement, as depicted in FIG. 16. Alternatively, the cups 30 of the brassiere 32 may be folded about the intercup bridge 34 to place the outer peripheral edges 14 of the shells 12*a* in a substantially confronting arrangement, as described above. As best depicted in FIGS. 11–14, the outer peripheral edges 14 of the shells 12*a* depicted in FIGS. 9–16 are formed in an undulating arrangement such that the entire circumference of the peripheral edges 14 do not lie in the same plane. Accordingly, not all portions of the outer peripheral edges 14 of the shells 12*a* will contact a flat surface upon which the frame 10*a* may be placed. In this configuration, the non-contacting portions of the outer peripheral edges 14 facilitate increased flow of air beneath the shells 12*a* to thereby provide more efficient drying of a laundered brassiere 32 placed thereon.

In the embodiment shown, the first clasps 40 are integral with respective apertures 16 formed through the shells 12*a* and are configured in patterns that correspond to the apertures 16. In particular, each clasp 40 is formed in the general shape of a scroll to facilitate positioning a shoulder strap 36 beneath the clasp 40 and tightly securing the strap 36 to the shell 12*a*. The first clasps 40 are flexibly constructed so that the straps 36 or cups 30 of the brassiere 32 are resiliently engaged and secured to the frame 10*a*.

The shells 12*a* may further include second clasps 42 provided near the respective peripheral edges 14 and positioned relative to the first clasps 40 such that the second clasps 42 may receive the intercup bridge 34 therethrough, as best depicted in FIG. 16. Use of the first and second clasps 40, 42 in conjunction helps to keep the cups 30 of the brassiere 32 tautly secured over the outer surface of the shells 12*a*.

The shells 12*a* may further include one or more third clasps 44 disposed near the outer peripheral edges 14 and configured to receive respective edges of the cups 30 of the brassiere 32 placed over the shells 12*a*. The third clasps 44 cooperate with the first and second clasps 40, 42 to secure the brassiere 32 to the frame 10*a*.

FIGS. 17–23 depict another exemplary embodiment of a frame 10*b* for supporting brassieres 32 in accordance with the principles of the present invention. The frame 10*b* includes first and second shells 12*b*, similar to those described above with respect to FIGS. 9–16, and corresponding features have been similarly numbered. The first and second shells 12*b* are coupled together by a connecting member 50 extending intermediate the respective peripheral edges 14 of the shells 12*b*. The connecting member 50 may be configured to fixedly maintain the first and second shells 12*b* in a tandem arrangement, or may be configured to permit the first and second shells 12*b* to pivot about the connecting member 50. In the embodiment shown, the first and second shells 12*b* are hingedly coupled to the connecting member 50, such as by living hinges 52, whereby the first and second shells 12*b* may be disposed in a tandem arrangement or may be folded about the connecting member 50 such that the respective peripheral edges 14 of the shells 12*b* are arranged in a generally confronting relationship.

The shells 12*b* of the frame 10*b* may be formed from a first polymeric material, as described above. In the embodiment shown, the shells 12*b* do not have a second polymeric material provided on the outer surfaces 18, however, it will be recognized that the outer surfaces 18 of the shells 12*b* may alternatively be provided with a second polymeric material to facilitate frictionally engaging the cups 30 of a brassiere 32, as discussed above, or the entire outer surfaces 18 of the shells 12*b* may be covered with the second polymeric material. Alternatively, the second polymeric material may be provided on selected portions of the shell interior, opposite outer surface 18, or the shells 12*b* may be entirely encapsulated in the second polymeric material.

FIGS. 24–31 depict another exemplary embodiment of a frame 10*c* for supporting brassieres in accordance with the principles of the present invention. The frame 10*c* includes first and second generally hemispherically-shaped shells 12*c* coupled by an interconnecting member 50, similar to the frame 10*b* of FIGS. 17–23 described above. Accordingly, similar features have been similarly numbered. In this embodiment, the plurality of apertures 16 formed through the first and second shells 12*c* are shaped and arranged to define heart-shaped structures in the remaining portions of the shells 12*c*. The frame 10*c* includes first clasps 40 provided on the respective peripheral edges 14 of the shells 12*c*, in the form of open sections in the heart-shaped structures, for receiving and securing the shoulder straps 36 or edges of cups 30 of a brassiere 32, as discussed above. In the embodiment shown, each shell 12*c* includes two first clasps 40, located at different positions on the outer peripheral edge 14, to better accommodate the straps of various brassiere styles. The frame 10*c* may further include second clasps 42 provided on the outer peripheral edges 14 of the respective shells 12*c* and operatively positioned relative to the first clasps 40 to receive the intercup bridge 34 of a brassiere 32 therethrough when the shoulder straps 36 of the brassiere 32 are extended through the first clasps 40, as discussed above.

Figure 27:
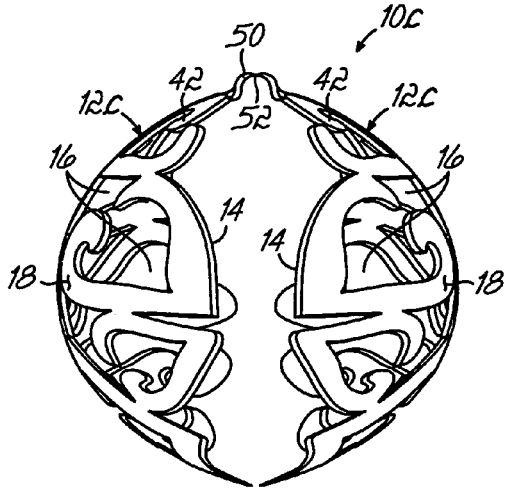
FIG. 27 is a front-side elevation view of the frame of FIG. 24 shown in an articulated position.
Figure 28:
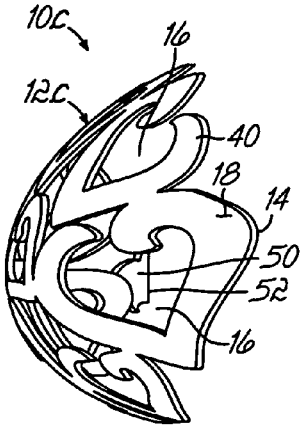
FIG. 28 is a right-side elevation view of the frame of FIG. 24.
Figure 29:
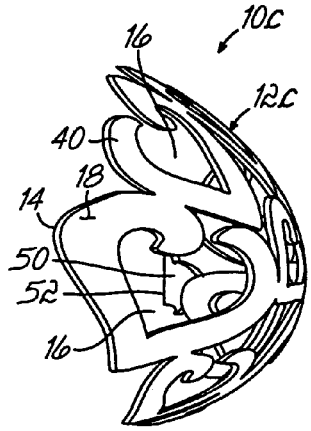
FIG. 29 is a left-side elevation view of the frame of FIG. 24.
Figure 30:
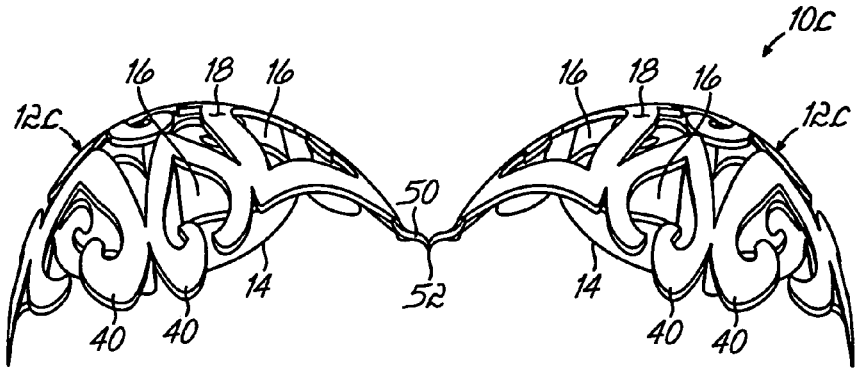
FIG. 30 is a rear-side elevation view of the frame of FIG. 24.
Figure 31:
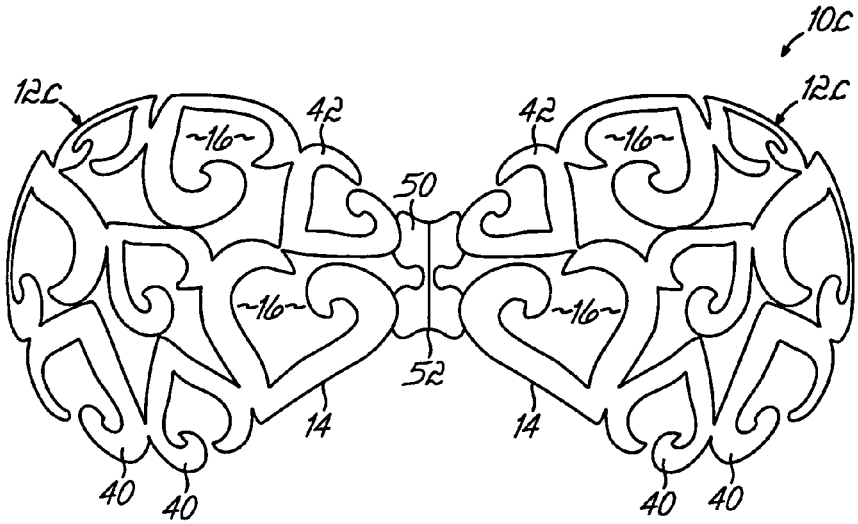
FIG. 31 is a bottom plan view of the frame of FIG. 24.

In this embodiment, the connecting member 50 between the first and second shells 12*c* may be configured to fixedly retain the first and second shells 12*c* in a substantially tandem arrangement, as depicted in FIGS. 24–26, 30 and 31, or may be configured to permit the first and second shells 12*c* to be pivoted about the connecting member 50 such that the outer peripheral edges 14 of the shells 12*c* are placed in a substantially confronting arrangement, as depicted in FIG. 27.

As discussed above with respect to the embodiments depicted in FIGS. 1–23, the frame 10*c* may be formed from a first polymeric material which is suitable for providing a rigid structure capable of supporting a brassiere 32 thereon. The frame 10*c* may further include a second polymeric material having a durometer that is less than the durometer of the first material, for facilitating frictional engagement with the cups 30 of the brassiere 32 placed on the frame 10*c*.

The second polymeric material may be disposed on selected areas of the outer surface 18 of the frame 10*c*, or it may completely cover the outer surface 18 of the frame 10*c*. Alternatively, the second polymeric material may be provided on selected portions of the shell interior, opposite outer surface 18, or the shells 12*c* may be entirely encapsulated in the second polymeric material.

While the present invention has been illustrated by the description of one or more embodiments thereof, and while the embodiments have been described in considerable detail, they are not intended to restrict or in any way limit the scope of the appended claims to such detail. Additional advantages and modifications will readily appear to those skilled in the art. The invention in its broader aspects is therefore not limited to the specific details, representative apparatus and methods and illustrative examples shown and described. Accordingly, departures may be made from such details without departing from the scope or spirit of Applicant's general inventive concept.

What is claimed is:

1. A brassiere frame for supporting at least one cup of a brassiere, comprising:

a first hemispherically-shaped shell formed from a first polymeric material having a first hardness, the first shell having an outer surface and an outer peripheral edge;

a plurality of apertures formed through the first shell; and a second polymeric material integrally molded onto at least selected portions of the outer surface and adapted to frictionally retain a cup of a brassiere thereon.

2. The frame of claim 1, wherein the second polymeric material has a second hardness that is less than the first hardness.

3. The frame of claim 1, further comprising:

at least one clasp proximate the outer peripheral edge and adapted to receive a strap of the brassiere therethrough to thereby secure the brassiere to the first shell.

4. The frame of claim 3, wherein the clasp is at least partially integral with one of the apertures.

5. The frame of claim 3, wherein the clasp has a generally volute shape.

6. The frame of claim 3, further comprising:

first and second clasps on the first shell, the first clasp adapted to receive a strap of the brassiere therethrough, the second clasp adapted to receive a bridge extending between the cups of the brassiere when the strap extends through the first clasp.

7. The frame of claim 1, further comprising:

a second hemispherically-shaped shell formed from the first polymeric material having the first hardness, the second shell having a second outer surface and a second outer peripheral edge;

a plurality of apertures formed through the second shell;

the second polymeric material integrally molded onto at least selected portions of the second outer surface of the second shell and adapted to frictionally retain thereon a cup of the brassiere.

8. The frame of claim 7, wherein the first and second shells are hingedly connected proximate their respective outer peripheral edges.

9. The frame of claim 8, wherein the first and second shells are movable about the hinged connection to place the respective peripheral edges adjacent one another in confronting relationship.

10. The frame of claim 7, wherein the second polymeric material has a second hardness that is less than the first hardness.

11. The frame of claim 7, wherein each of the first and second shells further comprise:

at least one first clasp disposed proximate the outer peripheral edge for receiving a strap of the brassiere therethrough to secure the brassiere to the respective shell.

12. The frame of claim 11, wherein each of the first and second shells further comprise:

at least one second clasp, the first clasp adapted to receive a strap of a brassiere therethrough, the second clasp adapted to receive a bridge extending between the cups of a brassiere when a strap of the brassiere extends through the first clasp.

13. A method of maintaining the shape of a brassiere, comprising:

placing a brassiere frame within at least one cup of the brassiere, the frame including at least one hemispherically-shaped shell formed from a first polymeric material having a first hardness, and a second polymeric material disposed on at least selected areas of the outer surface of the shell; and frictionally retaining the cup of the brassiere with the second polymeric material.

14. The method of claim 13, further comprising:

inserting a strap of the brassiere through a first clasp disposed proximate an outer peripheral edge of the hemispherically-shaped shell.

15. The method of claim 14, further comprising:

inserting a bridge of the brassiere through a second clasp disposed on the outer peripheral edge of the hemispherically-shaped shell.

16. The method of claim 13, wherein the frame comprises first and second hemispherically-shaped shells hingedly coupled together, the method further comprising:

inserting the first hemispherically-shaped shell into one cup of the brassiere;

inserting the second hemispherically-shaped shell into a second cup of the brassiere; and folding the first and second hemispherically-shaped shells about the hinged coupling to place the respective peripheral edges of the first and second shells adjacent one another in confronting relationship.

17. A brassiere frame for supporting at least one cup of a brassiere, comprising:

at least one hemispherically-shaped shell, the shell having an outer peripheral edge;

a plurality of apertures formed through the shell; and at least one first clasp integrally formed with the shell proximate the outer peripheral edge and adapted to receive a strap of the brassiere therethrough, the first clasp being configured to resiliently engage the strap to thereby secure the brassiere to the shell.

18. The frame of claim 17, further comprising:

at least one second clasp adapted to receive a bridge extending between the cups of the brassiere when a strap of the brassiere extends through the first clasp.

19. The frame of claim 17, wherein the apertures are sized and shaped to give the shell a decorative appearance.

20. The frame of claim 3, wherein the at least one clasp is formed into the outer peripheral edge of the shell.

* * * * *

UNITED STATES PATENT AND TRADEMARK OFFICE

CERTIFICATE OF CORRECTION

PATENT NO. : 7,252,573 B2
APPLICATION NO. : 11/272930
DATED : August 7, 2007
INVENTOR(S) : Michele Mann It is certified that error appears in the above-identified patent and that said Letters Patent is hereby corrected as shown below:

On the title page item (56), under U.S. Patent Documents

Column 1
Line 2, reads "...2,490,508...Delgatlo..." and should read -- ...2,490,508...Delgatto… -- .

Column 4
Line 15, reads ""…portions the outer surface 18…" and should read -- ...portions of the outer surface 18… -- .

Column 8
Line 1-2, claim 11, reads "...wherein each of the...comprise:" and should read --...wherein each of the...comprises: -- .

Line 7-8, claim 12, reads "...wherein each of the...comprise:" and should read -- ...wherein each of the...comprises:" -- .

Signed and Sealed this

Twenty-fifth Day of December, 2007

JON W. DUDAS
*Director of the United States Patent and Trademark Office*